US005635031A

United States Patent [19]

Enkvist

[11] Patent Number: 5,635,031

[45] Date of Patent: Jun. 3, 1997

[54] METHOD IN A PAPER MACHINE OR IN A FINISHING DEVICE OF A PAPER MACHINE FOR COLLECTING AND REMOVING DUST SEPARATED FROM A WEB

[75] Inventor: Jens P. Enkvist, Turku, Finland

[73] Assignee: Valmet Corporation, Helsinki, Finland

[21] Appl. No.: 498,908

[22] Filed: Jul. 6, 1995

[51] Int. Cl.[6] ..... D21F 1/32

[52] U.S. Cl. ..... 162/199; 162/272

[58] Field of Search ..... 162/199, 272; 15/4, 300.15, 301, 345, 346, 257.3, 322, 330, 405, 415.1

[56] References Cited

U.S. PATENT DOCUMENTS

| | | | |
|---|---|---|---|
| 3,486,309 | 12/1969 | Wild | 15/301 |
| 4,003,276 | 1/1977 | Schmitt | 83/100 |
| 4,270,978 | 6/1981 | Fioravanti | 162/199 |
| 4,364,147 | 12/1982 | Biedermann et al. | 15/404 |
| 4,540,469 | 9/1985 | Lundström | 162/199 |
| 4,715,078 | 12/1987 | Howard et al. | 15/4 |
| 4,822,454 | 4/1989 | Meirowitz et al. | 162/199 |
| 4,835,808 | 6/1989 | Hahne et al. | 15/1.5 R |
| 5,304,254 | 4/1994 | Chino et al. | 134/37 |
| 5,363,676 | 11/1994 | Tsuchiya | 66/168 |
| 5,519,945 | 5/1996 | Ahvenniemi et al. | 15/345 |

*Primary Examiner*—Donald E. Czaja
*Assistant Examiner*—Jose A. Fortuna
*Attorney, Agent, or Firm*—Steinberg, Raskin & Davidson, P.C.

[57] ABSTRACT

A method in a paper machine or in a finishing device of a paper machine for collecting and removing dust and other particulate material separated from or in the vicinity of a web. Air that contains the dust is transferred by air blowings, specifically, a first air flow is directed from a first blow nozzle to flow in the cross direction of the machine from the tending side of the machine to the driving side. This first air flow carries the dust separated from the web or equivalent along with it. The dust-laden air flow is turned downwards by a second air flow being directed from a second blow nozzle to be drawn into a suction box.

7 Claims, 3 Drawing Sheets

METHOD IN A PAPER MACHINE OR IN A FINISHING DEVICE OF A PAPER MACHINE FOR COLLECTING AND REMOVING DUST SEPARATED FROM A WEB

FIELD OF THE INVENTION

The present invention relates to a method in a paper machine or in a finishing device situated in a paper machine for collecting and removing dust and other particulate material that is separated from the web, in which method the air that contains dust is transferred by means of air blowings.

Further, the present invention relates to a device in a paper machine or in its finishing device for collecting and removing dust and other particulate that is separated from the web, which device comprises blow means for the transfer of the air that contains dust as air flows and removal means for removing air that contains dust separated from the web.

BACKGROUND OF THE INVENTION

After the making of a web of paper in a paper machine, dust and impurities adhere to the face of the paper web, such as debris and fibers derived from the dryer section of the paper machine. A further important source of dust is, for example, the creping process. The dust that is separated from the face of the paper web, especially when the web is unwound, for example, in a slitter-winder, spreads in the paper mill and in the finishing into the environment, i.e., into the machine hall in which the paper machine is situated. This dust that spreads into the environment causes several problems and associated drawbacks. The most important drawback is the contamination of breathing air in the working environment beyond permitted limits. Another important drawback being the substantially increased risk of fire due to the presence of the dust.

In the machine hall, as a rule, an air flow is present that flows from the dry end of the hall, where, for example, the slitter-winder is placed, towards the wet end of the hall. A part of the dust that floats in the air, and in fact a major part, rests as a deposit on various equipment surfaces present in the hall, such as on the frame beams of the machine, on crane rails, and on various ducts and pipes, whose daily cleaning is quite difficult. Some of these equipment surfaces, such as a part of the Yankee hood and its related devices, are also very hot and may ignite the dust settling thereon.

From the prior art, devices are known by whose means attempts are made to remove dust from the web locally, for example, by means of dust-removing boxes. Such boxes are placed in suitable locations, for example, in the vicinity of the slitter-winder. With respect to the prior art related to this type of devices, reference is made, e.g., to U.S. Pat. Nos. 4,715,078 and 3,239,863.

In U.S. Pat. No. 4,715,078, a method and a device are described for cleaning the edges of a paper web at a slitter-winder and for removing the dust detached from the edges. In the device shown in this reference, two cleaning rolls are used, which are placed strategically in the path of running of the paper web. The first cleaning roll contacts the forward edge of the paper web when the paper web runs further from the slitter. At the same time as the paper web runs further, its upper face is also cleaned by the same roll. The second cleaning roll cleans the rear edge of the paper web as it runs further. By means of the second cleaning roll, the lower face of the paper web is also cleaned. After this, by means of a vacuum system, the particles and dust that are detached by the cleaning rolls are removed, and all of the four edges of the paper web are also cleaned. The pressure system removes the particles from the face of the paper web so that they can be carried off by means of the vacuum system.

In U.S. Pat. No. 3,239,863, a web cleaning device is described, in which a chamber space is employed, in which two air nozzles directed towards the web have been formed. The space between the nozzles is closed so that it forms an exhaust chamber for the air discharged from the nozzles and for the dust detached from the web.

It is one particular problem of these prior art devices that they are local, i.e., their fields of application are quite dependent on the lay-out of the paper finishing device that is used, such as the slitter-winder. In a number of applications in which a paper web is unwound, there are several sources of dust from which dust is liberated into the hall. Thus, from two even up to five devices based on local dust removal are needed for each unwind station, in which case the dust-removing system becomes quite spacious and complicated.

OBJECTS AND SUMMARY OF THE INVENTION

Accordingly, it is an object of the present invention to provide a dust removal method and device by whose means the removal of dust is carried out at the unwind stage of a paper web in a paper machine so that the system is less expensive and simpler to carry into effect as compared with prior art methods and devices.

Another object of the present invention is to provide a method and a device for removing dust by whose means the environment of a paper machine or of its finishing device, in particular the environment of an unwind station, can be cleaned from dust while preventing the spread of dust into the environment.

In view of achieving the objects stated above and others, in the method in accordance with the invention, an air flow is produced by means of a blow nozzle, which nozzle blows an air flow in the cross direction of the machine from the tending side of the machine to the driving side of the machine, i.e., in a direction transverse to the running direction of the web. This air flow carries the dust and other particulate matter separated from the web or equivalent along with it. This air flow is later redirected, and preferably turned downward, after it has traversed substantially the entire width of the web by means of an additional blow nozzle and forms an air flow which is absorbed into a suction box situated in the path of the redirected or turned air flow.

The device in accordance with the invention comprises two air-curtain nozzles, of which the first one is placed at the tending side of the machine, a cross-direction air flow being produced by means of this nozzle above the paper machine or its finishing device from the tending side of the paper machine to the driving side. The other nozzle is arranged at the driving side to turn the cross-direction air flow downwards into a suction box of the device.

As an advantage of the present invention, it is achieved, among other things, that the arrangement is not dependent on the lay-out solution of the unwind-slitter station, so that the method in accordance with the invention is directly applicable to most of the different types of, for example, soft-tissue slitters and equivalent irrespective of the number of unwind stations used in the particular application.

The arrangement in accordance with the present invention is based on two blow nozzles, one of which is placed at the tending side of the machine and the other one at the driving side. Both nozzles are low-pressure air-curtain nozzles whose length in the longitudinal direction of the machine is arranged to be in compliance with the number of the unwind stations, i.e., to extend a sufficient length to have an effect on the paper reels in all of the unwind stations. The nozzle placed at the tending side of the machine blows in the cross direction of the machine and of the web, i.e., toward the driving side, and the nozzle placed at the driving side blows the dust-exhaust blow along a wall abutting a side of the driving side of the paper machine downward toward the suction box. The suction box that is used in the arrangement is connected with an air system which carries the contaminated air into a wet separator or into an equivalent filter from which the air is passed further either into the open air, into the basement, or back into the machine hall.

According to the invention, a suitable area in the paper machine hall, i.e., the unwind portion of a slitter-winder or of an equivalent finishing device, is isolated from the rest of the machine hall by non-mechanical means, i.e., by means of an air curtain, which carries air and by whose means an efficient air-conditioning of the area is achieved. It is a further advantage of the method in accordance with the invention that it does not produce problems for the ordinary operation of the slitter, such as threading of the web.

In the following, the invention will be described in more detail with reference to the figures in the accompanying drawing. The invention is, however, by no means strictly confined to the details of the illustrated embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF TEE INVENTION

Figure 1:
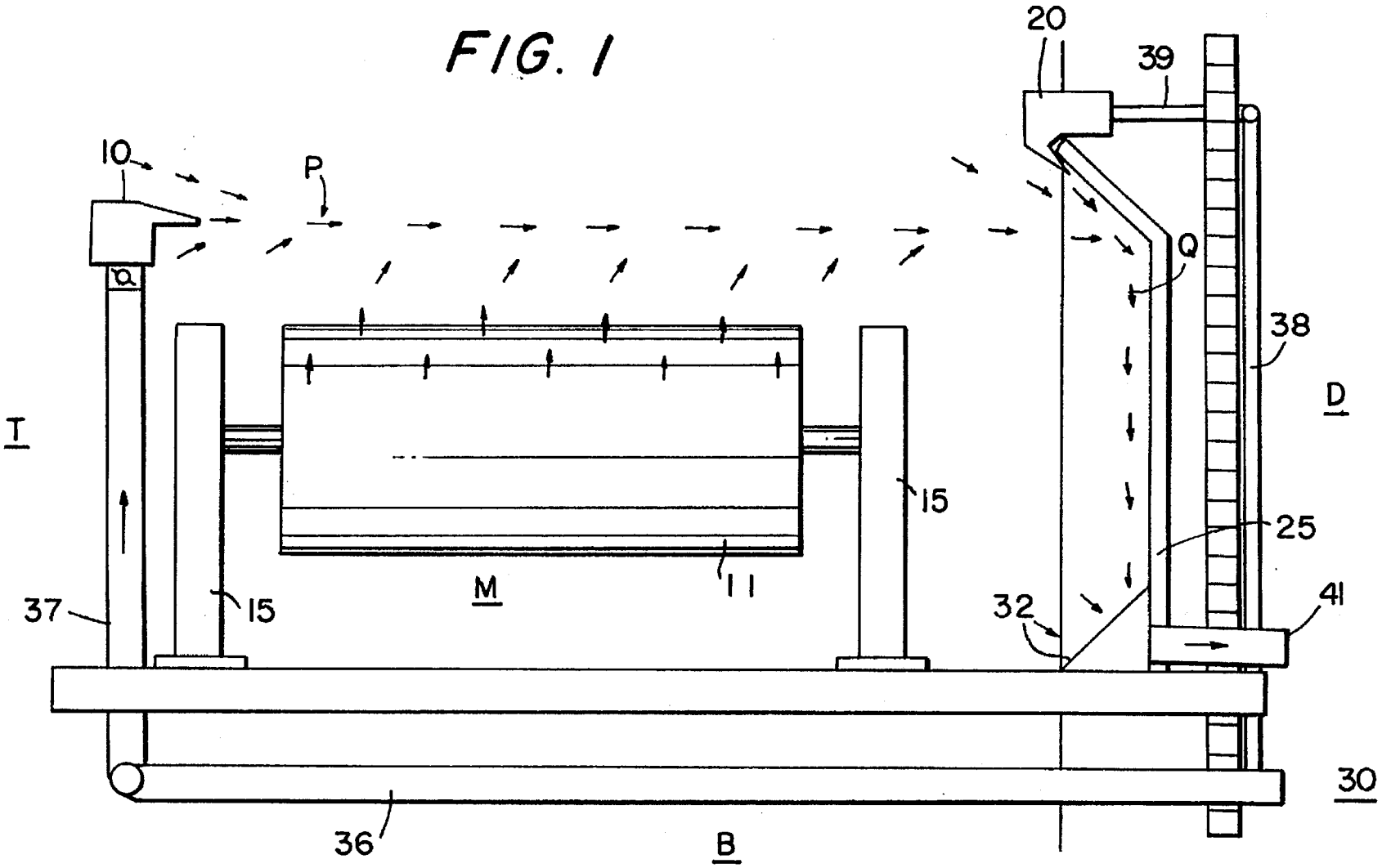
FIG. 1 is an illustration of an embodiment of the arrangement in accordance with the invention in the direction of width of the machine and used in the method in accordance with the invention.
Figure 2:
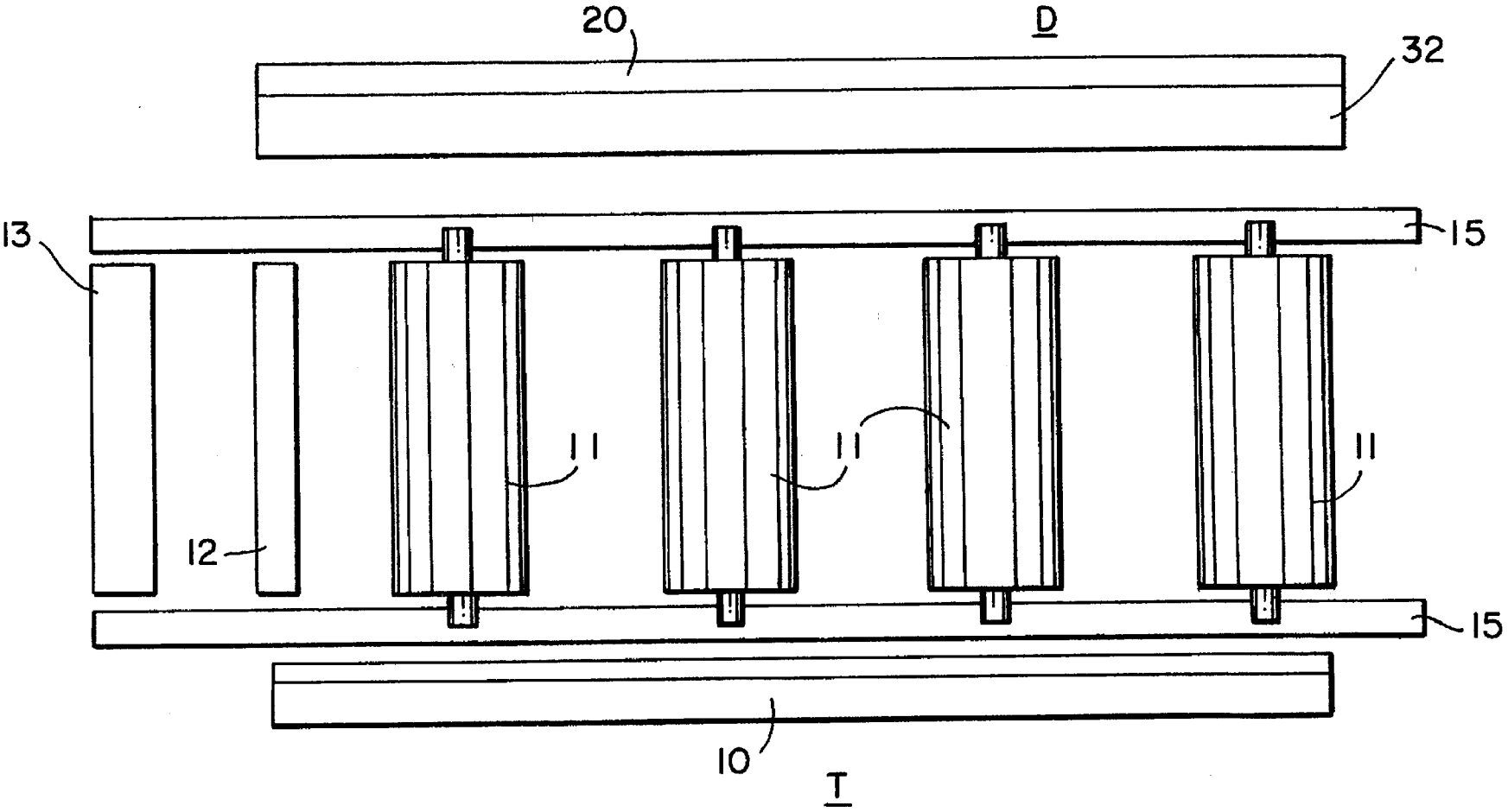
FIG. 2 is an illustration of an embodiment of the arrangement in accordance with the invention in the longitudinal direction viewed from above.
Figure 3:
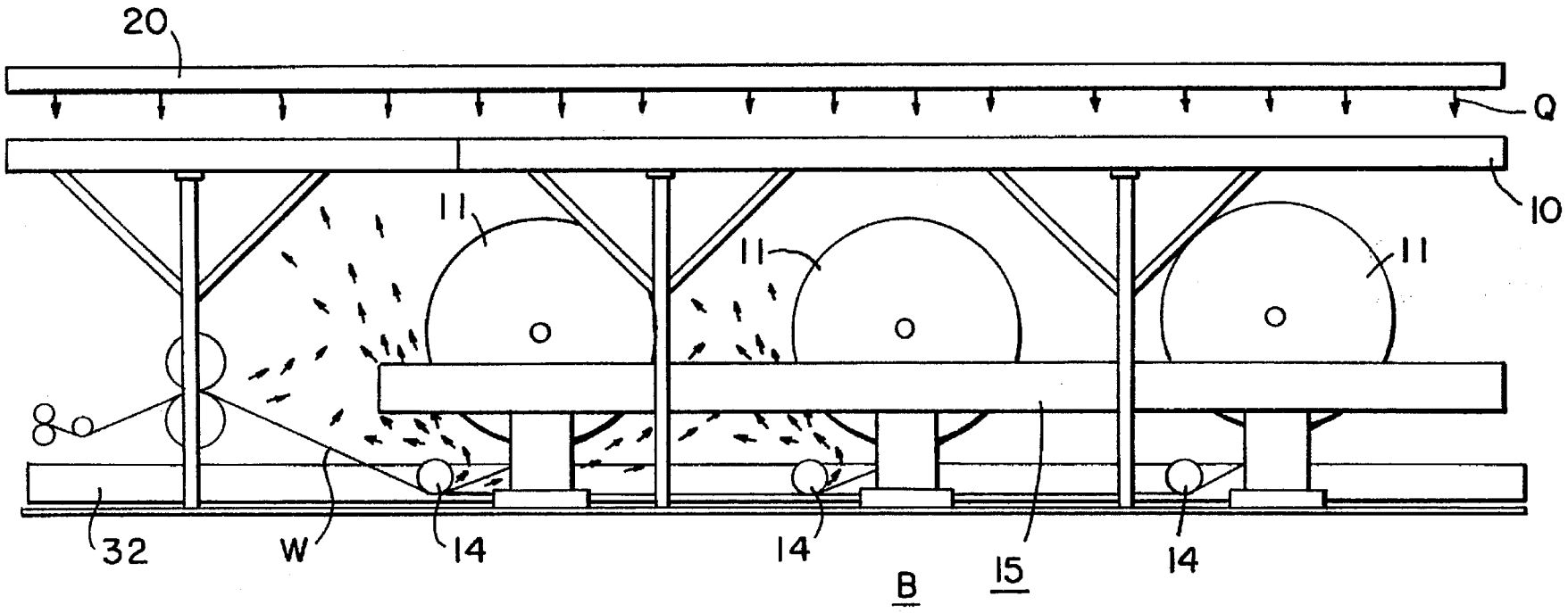
FIG. 3 is a side view of an embodiment of the arrangement in accordance with the invention in the longitudinal direction.

Referring to the accompanying drawings wherein the same reference numerals refer to the same or similar elements, in the embodiments of unwind stations shown in FIGS. 1–3, paper reels are denoted by reference numeral 11. The paper reels 11 are arranged to revolve on support of frame constructions 15 and the construction of the unwind station will not be described in more detail in this connection, because the invention is suitable for use in connection with unwind stations of many different types. The slitter station is denoted by reference numeral 13 and the calender is denoted by reference numeral 12 (FIG. 2). In the illustrated embodiment, the air flows effective in an unwind station are denoted generally with arrows. In FIG. 3, the guide rolls of the paper web W are denoted by reference numeral 14.

The dust removal method and device in accordance with the invention eliminates the dust that arises on unwinding among other things, whereby the dust level in the machine space is lowered to a desired, acceptable level. As represented by the arrows in FIGS. 1–3, dust and other particulate matter that arises in connection with unwinding tends to move upward or rise because of the revolving paper reels 11 and rolls 14, which produce turbulence, and because of the thermodynamic higher temperature arising from the web guide rolls 14 and from the paper reels, which temperature is higher than the temperature in the environment, which also produces air flows upwards. In the invention, these upwardly directed air flows are turned toward a driving side D of the machine by means of an air-curtain nozzle 10 situated at the driving side. From air-curtain nozzle 10, an air flow is directed or blown to force air from the tending side T to the driving side D (FIG. 1). As the nozzle velocity in the nozzle 10, a sufficiently high velocity is employed in order that the desired transverse flow, i.e., transverse to the running direction of the web, could be produced all the way to the driving side of the machine. The air flow that comes across the machine is then turned by another air-curtain nozzle 20 downward along a wall plate 25 into suction boxes 32 placed on the floor of the machine hall. The suction boxes 32 form part of an air delivery and removal system 30 and are, of course, provided with shields (not shown) which prevent access of paper broke or equivalent into the system. In the exhaust air ducts coupled to the suction boxes, a high air velocity is employed in order that dust should not accumulate in these ducts.

The system in accordance with the present invention consists of three main components, i.e., the air-curtain nozzles 10, 20 and the air system 30, which includes air ducts and an air cleaner, for example a wet separator or some other filter. As shown in FIGS. 1–3, the air-curtain nozzles 10, 20 produce controlled air flows P, Q, respectively. The air flows P, Q form air curtains which isolate the dust of the unwind process and prevent its spreading, in which case the dust is not transferred from the unwind area into the rest of the machine hall.

As shown in FIG. 1, the system includes two nozzles 10, 20, of which one, nozzle 10, blows the air flow P that contains dust particles and other impurities across the machine from the tending side T thereof to the driving side D thereof, and the other nozzle 20 directs the air flow Q downward toward the suction box 32 of the air system 30. In the air-curtain nozzles 10, 20, preferably nozzles are used in which there are two different slot widths, depending on the width of the air curtain. The nozzle 10 that blows the air flow P across the machine has a jet length of, for example, from about 5 m to about 10 m, and the nozzle 20 at the driving side, which blows air flow Q down along the wall plate 25, has a jet length of, for example, about 4 m to about 7 m. The nozzles 10, 20 are provided with separate blowers, and the air is preferably filtered.

The air system 30 further comprises air ducts 36, 37 and 38, 39 for the air-curtain nozzles 10 and 20, respectively. The air system 30 also comprises blowers (not shown) for the nozzles 10, 20 and for the suction box 32. The blowers are placed preferably in a basement space B below the machine level M. At the intake side, the air is blown from the basement space B to the machine level M along the ducts 36, 37, 38, 39. At the outlet side, the air passes from the suction box 32 through a duct 41 through the blower, which is placed in the basement space B. The exhaust air flows, for example, through a wet separator and in a manner in itself known, in the filter, such as a wet separator, the dust particles are separated from the air flow. The cleaned air can also be passed back into the blower of the basement space or be blown, for example, through the roof as exhaust air into the open air.

In the dust removal method and device in accordance with the invention, the nozzle velocities of air flows P, Q are about 10 meters to about 15 meters per second, and the nozzle at the driving side is placed at a level about 1 m to about 2 m higher than the nozzle of the tending side, whereby it is taken into account that the air jet produced becomes wider as a function of the distance. As the amount of exhaust air that is used in the system, an amount is used that is about 1.5 to about 0.3 times the air amount of the air-curtain blowing.

The examples provided above are not meant to be exclusive. Many other variations of the present invention would be obvious to those skilled in the art, and are contemplated to be within the scope of the appended claims.

I claim:

1. A method in a paper machine or in a finishing device of a paper machine for collecting and removing dust separated from a web at a dry end of the paper machine at which the web is at least partially dried, the paper machine having a tending side and a driving side, comprising the steps of:

directing a first air flow from a first blow nozzle in a cross direction of the machine from the tending side of the machine to the driving side of the machine to carry dust separated from the web therewith, drawing air from the driving side of the machine into a suction box, and directing a second air flow from a second blow nozzle into the path of said first air flow at the driving side of the machine to redirect said first air flow toward said suction box such that said second air flow is drawn into said suction box, and collecting the dust at a location after said suction box.

2. The method of claim 1, wherein the paper machine is situated in a machine hall, further comprising the steps of:

positioning at least said first blow nozzle at a level above rolls supported on frame constructions of the paper machine such that said first air flow is directed above the rolls, and forming air curtains from said first and second air flows to separate the source of dust in the paper machine from the rest of the machine hall.

3. The method of claim 1, further comprising the steps of:

directing the air from said suction box to an air cleaning device, and cleaning the air in said air cleaning device to thereby cause the dust to be separated from the air and collected.

4. The method of claim 1, further comprising the steps of:

coupling said first and second blow nozzles to ducts, and arranging a blower device in connection with said ducts to direct air through said ducts into said first and second blow nozzles to form said first and second air flows.

5. The method of claim 1, wherein the step of drawing air into said suction box comprises the step of arranging a blow device in connection with said suction box for causing air to flow into said suction box.

6. The method of claim 1, further comprising the step of providing said first air flow with a sufficiently high velocity to ensure that said first air flow flows substantially across the entire distance from the tending side of the machine to the driving side of the machine.

7. The method of claim 1, further comprising the step of arranging said second blow nozzle at a higher height level than said first blow nozzle.

* * * * *